United States Patent [19]

Ford et al.

[11] Patent Number: 4,538,748

[45] Date of Patent: Sep. 3, 1985

[54] TAMPER DETERRING UNLOCKING RESTRICTER FOR DOWN LOCKING PUMP DISPENSERS

[75] Inventors: John M. B. Ford, Lee's Summit; Donald D. Foster, Kingsville, both of Mo.

[73] Assignee: Realex Corporation, Kansas City, Mo.

[21] Appl. No.: 466,776

[22] Filed: Feb. 16, 1983

[51] Int. Cl.[3] ..... B67D 5/42

[52] U.S. Cl. ..... 222/321; 222/384

[58] Field of Search ..... 222/321, 153, 384, 402.11, 222/402.14; 215/217, 218, 222, 223

[56] References Cited

U.S. PATENT DOCUMENTS

| | | | |
|---|---|---|---|
| 2,103,932 | 12/1937 | Bernhardt | 222/384 X |
| 3,880,314 | 4/1975 | Akers | 215/222 X |
| 4,369,899 | 1/1983 | Magers et al. . | |
| 4,434,903 | 3/1984 | Cooke | 215/223 X |

*Primary Examiner*—Stanley H. Tollberg

*Attorney, Agent, or Firm*—Schmidt, Johnson, Hovey & Williams

[57] ABSTRACT

The plunger of the pump has a radially extending lug near its upper end which can be inserted down into a notch in the stationary pump collar when the plunger is fully depressed, so that when the plunger is then rotated in a clockwise direction relative to the collar, the lug is brought under an overhanging ledge on the collar to releasably lock the plunger in its fully depressed position. In order to deter unlocking, the lug of the plunger and the interior wall of the collar are provided with mutually interengageable structures that permit the lug to be rotated substantially without significant resistance into a final or fully locked up position against a shoulder beneath the ledge but to be held in such fully locked up position against unlocking movement unless substantial, counterclockwise-directed force is applied. Interengaging ramp surfaces on the collar and the lug slide against one another during movement of the lug into its locked up position, while abrupt, blocking surfaces thereafter oppose one another to prevent unlocking rotation unless significant force is applied to override the blocking action. The underside of the retaining ledge of the collar is also provided with a depending abutment adjacent the notch which lies in the path of travel of the lug during attempted unlocking rotation to thereby block access of the lug to the notch unless the plunger is first depressed a sufficient amount to permit passage of the lug under the abutment.

7 Claims, 20 Drawing Figures

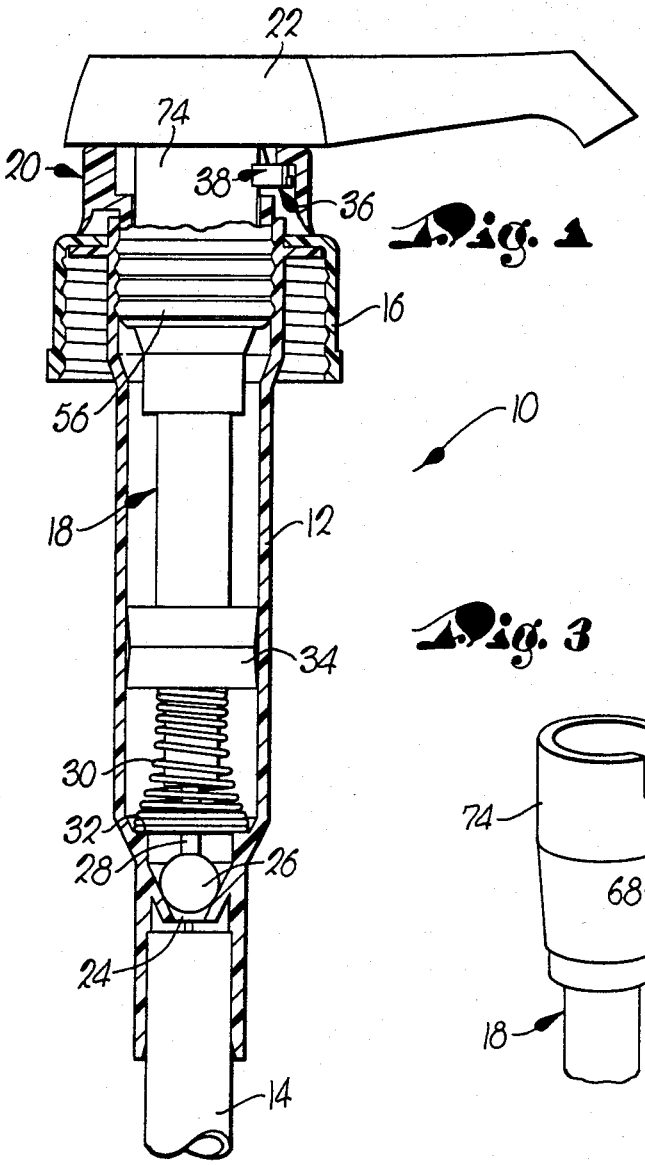
Fig. 1
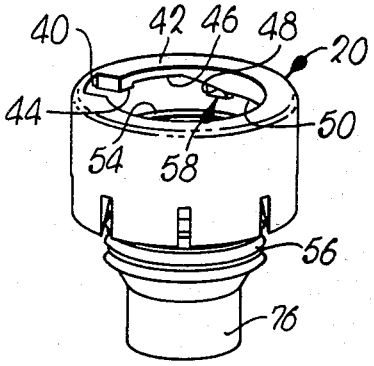
Fig. 2
Fig. 3
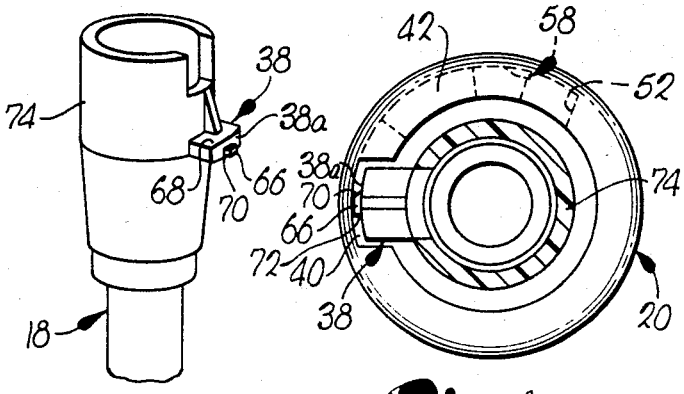
Fig. 4
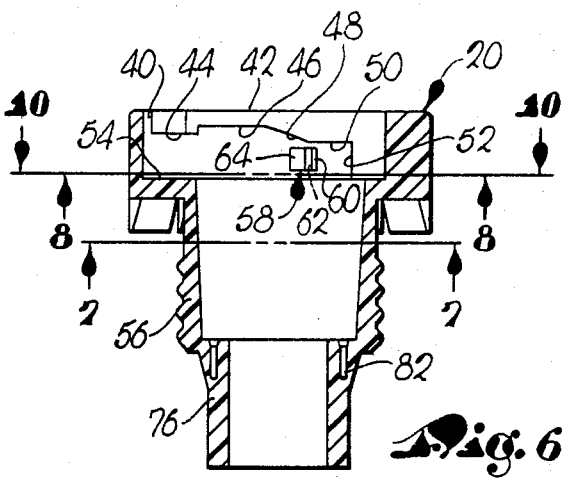
Fig. 6
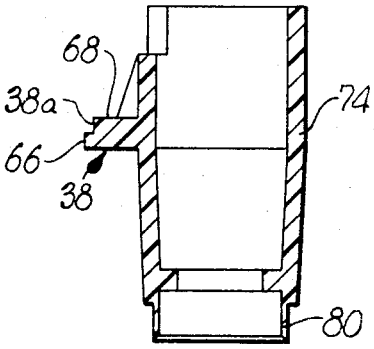
Fig. 13

TAMPER DETERRING UNLOCKING RESTRICTER FOR DOWN LOCKING PUMP DISPENSERS

BACKGROUND OF THE INVENTION

1. Technical Field

This invention relates to dispensing pumps and, more particularly, to locking and unlocking improvements with respect to those pumps in which the plungers are locked down in fully depressed positions for shipment and shelf storage purposes.

2. Background Art

Lock down dispensing pumps are not new per se. See for example prior U.S. Pat. No. 4,369,899 owned by the assignee of the present invention.

While such locking arrangements, in which a radial lug or ear on the plunger is trapped beneath an overhanging ledge of the pump collar, have proven quite effective, there is nothing in that construction to inhibit or restrict unlocking of the plunger except for the frictional drag which is inherently created between the lug and the overhanging ledge of the collar.

Furthermore, in the event the pump uses a return spring for the plunger, there is nothing in such arrangements to prevent rather instantaneous extension of the plunger once the locking lug has been released from beneath the ledge, and such instantaneous extension has an adverse effect upon the ability of the pump to become fully primed in preparation for a subsequent depression stroke by the user. It has been found in this respect that a relatively slow, controlled extension of the pump from its locked down position is considerably more conducive to drawing a full charge of liquid into the pump chamber in a priming action than is true when the plunger is suddenly extended such as by the force of a relatively strong return spring within the body of the pump.

SUMMARY OF THE PRESENT INVENTION

Accordingly, one important object of the present invention is to provide a way of discouraging accidental or unauthorized unlocking of the plunger by providing an impediment to unlocking rotation thereof which can only be overcome through the application of a significant, normally intentional, unlocking rotational force. At the same time, however, it is important to avoid encountering that degree of force when placing the plunger in its fully locked up mode since to do so would inhibit placing the plunger into its tightly locked up condition. Moreover, it would discourage attainment of the proper anti-leak sealing action that occurs between certain interengaging parts of the pump when the plunger is fully and properly locked down.

Pursuant to the foregoing, the present invention contemplates having a pair of circumferentially spaced apart shoulders which project radially inwardly from the interior wall of the collar beneath the overhanging locking ledge thereof for the purpose of trapping the lug in a locked mode between the two shoulders. The lug has a projecting nib at its outer end provided with a ramp surface disposed in such a manner as to slidingly engage a corresponding ramp surface on one of the locking shoulders as the plunger is rotated clockwise into its fully locked position, thereby permitting such locking rotation to occur with relatively minimal resistance. However, once the nib is rotated past the inclined shoulder of the collar, the nib pops between the two shoulders in such a way that an abrupt blocking surface thereof is brought into direct opposition with a similar abrupt blocking surface on the inclined shoulder. Consequently, the plunger cannot be rotated out of its fully locked position without the two blocking surfaces abuttingly engaging one another to resist such unlocking movement, and completed unlocking rotation cannot occur until a sufficiently high level of rotative force is applied that the blocking interengagement is overridden.

Another important object of the present invention is to provide a way of encouraging the user to keep his hand applied to the head of the plunger at the instant the locking lug moves out from underneath the overhanging ledge of the collar and into the adjacent entry notch so that the user's own manual force applied to the plunger can be utilized to good advantage in retarding what might otherwise be an undesirable spring-powered, instantaneous extension of the plunger to its fully extended position. In this respect, the present invention contemplates the use of a depending abutment on the ledge immediately adjacent to the entry notch which blocks access of the locking lug to the notch unless the plunger is first depressed sufficiently to enable the lug to pass beneath the blocking abutment. Since the user must apply a depressing force manually in order to pass the lug under the abutment, his hand is likely to remain on the head of the plunger and thereby retard extension thereof when the lug becomes aligned with the notch and the plunger is thus rendered free to extend under the influence of the return spring of the pump.

BRIEF DESCRIPTION OF THE DRAWINGS

FIG. 1 is a vertical cross-sectional view of a dispensing pump embodying the concepts of the present invention, the plunger thereof being shown in its fully down and locked position;

FIG. 2 is a top, front perspective view of the collar thereof showing portions of the lock-down means for the plunger;

FIG. 3 is a fragmentary, top front perspective view of a component associated with the plunger and showing details of the locking lug;

FIG. 4 is a horizontal cross-sectional view across the parts of FIGS. 2 and 3 when the same are assembled together, the locking lug being illustrated within the receiving notch of the collar prior to locking rotation of the plunger;

FIG. 6 is a vertical cross-sectional view through the collar taken substantially along line 6—6 of FIG. 5;

FIG. 13 is a vertical cross-sectional view thereof;

DETAILED DESCRIPTION

Figure 5:
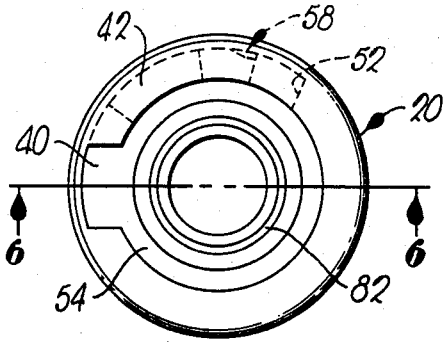
FIG. 5 is a top plan view of the collar.
Figure 7:
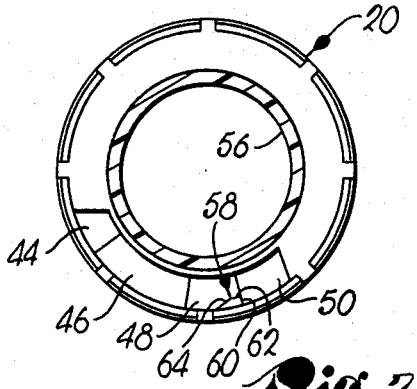
FIG. 7 is a transverse cross-sectional view of the collar taken substantially along line 7—7 of FIG. 6.
Figure 8:
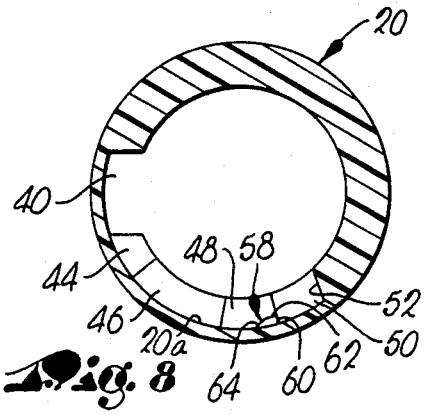
FIG. 8 is a transverse cross-sectional view thereof taken substantially along line 8—8 of FIG. 6.
Figure 9:
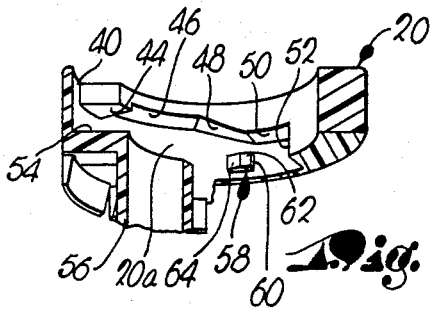
FIG. 9 is a fragmentary, bottom perspective view of the collar in transverse cross section revealing details of construction.
Figure 11:
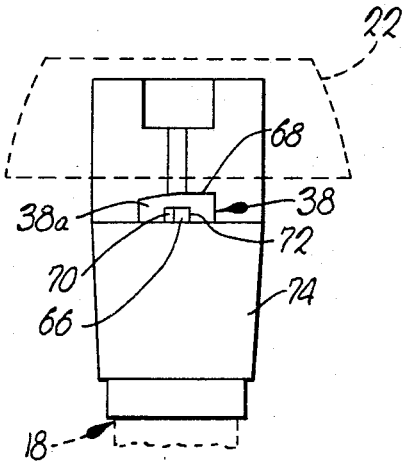
FIG. 11 is a slightly enlarged side elevational view of the plunger component of FIG. 3.
Figure 12:
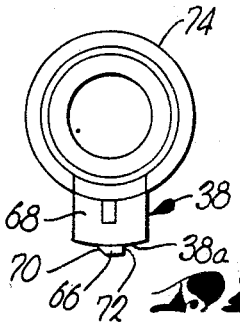
FIG. 12 is a top plan view thereof.
Figure 10:
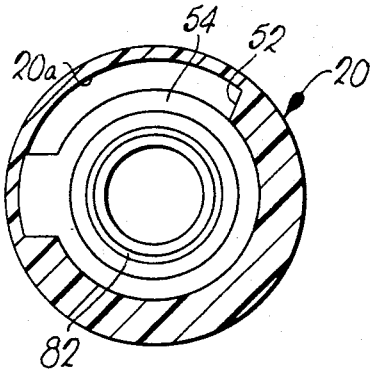
FIG. 10 is a transverse cross-sectional view of the collar taken substantially along line 10—10 of FIG. 6.
Figure 14:
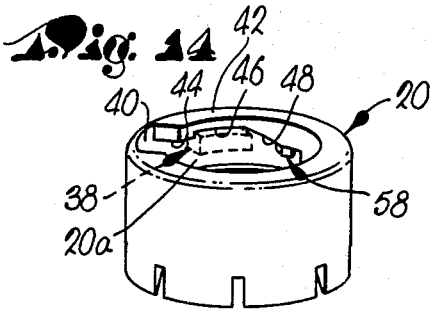
FIG. 14 is a partial top front perspective view of the collar as shown in FIG. 2 but illustrating in phantom lines the position of the locking lug as it is disposed beneath the locking ledge of the collar adjacent the depending abutment of the ledge.
Figure 16:
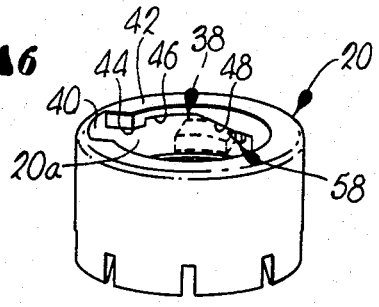
FIG. 16 is a perspective view of the collar and the locking lug similar to FIG. 14 but showing the lug as it is cammed down to lock up the sealing structures of the pump as the lug approaches its fully locked mode.

The pump 10 has a tubular body 12 fitted with a dip tube 14 at its lower end which is adapted to be inserted into liquid within a container (not shown) with which the pump 10 is utilized. The upper end of the body 12 is provided with a closure 16 adapted to thread onto the neck of the container and thereby attach the pump 10 thereto. A plunger broadly denoted by the numeral 18 reciprocates within the body 12 through a collar 20 secured to the open upper end of the body 12, and a dispensing head 22 is affixed to the upper end of the plunger 18 for directing pumped products out of the plunger 18 and for providing a convenient means for the user to apply an operating force to the plunger 18.

The body 12 has a reduced diameter inlet 24 just above the dip tube 14, and such inlet 24 is controlled by a ball check valve 26 in such a way that the inlet 24 is opened during extension strokes of the plunger 18 but is closed during depression strokes thereof. A projection 28 at the lower tip end of the plunger 18 engages the ball 26 to hold the latter down when the plunger 18 is in its fully down and locked position, and a coil spring 30 is trapped between a lower shelf 32 in the body 12 and a pumping piston 34 of the plunger 18, thereby yieldably biasing the plunger 18 toward a fully extended position. As will be readily understood by those skilled in the art, depression of the plunger 18 causes any products trapped between the piston 34 and the closed valve 26 to be driven into the interior of the hollow plunger 18 through orifices not shown and to then travel upwardly through an interior passage of the plunger 18 and out the spout of the operating head 22. Subsequently, on the upstroke of the plunger 18, the upwardly moving piston 34 has the effect of creating negative pressure within the area of the body 12 between the piston 34 and inlet 24 whereby to unseat the valve 26 and draw products up through the dip tube 14 into the lower portion of the body 12 for subsequently dispensing such products on the next depression of the plunger 18.

The plunger 18 and the collar 20 are provided with locking means therebetween which are broadly denoted by the numeral 36, such locking means 36 serving to provide the ability to selectively hold the plunger 18 in the fully down and locked position of FIG. 1. Broadly stated, such locking means 36 comprises a radial lug 38 on the plunger 18 which may be slipped downwardly into a notch 40 in an overhanging top ledge 42 of the collar 20. When the plunger 18 is rotated in the appropriate direction, the lug 38 may slip under the ledge 42, thereby retaining the plunger 18 locked down.

As illustrated perhaps most clearly in FIGS. 2, 4, 6 and 9, the underside of the ledge 42 is provided with a depending abutment 44 situated immediately adjacent the notch 40 in a clockwise direction therefrom as the collar 20 is viewed from the top. Next adjacent the abutment 42 is a relieved stretch 46 of the underside of ledge 42 extending in a clockwise direction from the abutment 44 for a short distance. At the clockwise termination of the recessed stretch 46, the underside of the ledge 42 is provided with a downwardly inclined cam surface 48 which then terminates in a normally horizontal surface 50 which is parallel with the top side of the ledge 42. At the clockwise termination of the parallel surface 50, a stop shoulder 52 is presented which extends vertically from surface 50 down to the upper extremity 54 of a vertically oriented, internal, recessed ring portion 56 of the collar 20.

The interior wall 20*a* of the collar 20 is provided with a second shoulder 58 that is spaced slightly below the underside of ledge 42 in alignment with the clockwise end of the inclined cam surface 48. Shoulder 58 projects outwardly from the interior wall 20*a* for a short distance, which is substantially less than one-half the width of the overhang of the ledge 42 measured in a radial direction, and is provided with a generally upright blocking surface 60 generally parallel to the shoulder 52 but in spaced opposition thereto in a circumferential direction. The shoulder 58 also has a radially inwardly directed, short face 62 and, at its opposite end, an inclined ramp surface 64 leading radially outwardly from the face 62 toward and intersecting with the wall 20*a*.

On the other hand, the lug 38 is provided with a radially outwardly projecting nib 66 at the radially outermost extremity 38*a* of lug 38. The construction of nib 66, and the relationship of the same and the lug 38 with components of the collar 20, can perhaps best be seen in FIGS. 3, 4, 11 and 20.

Figure 20:
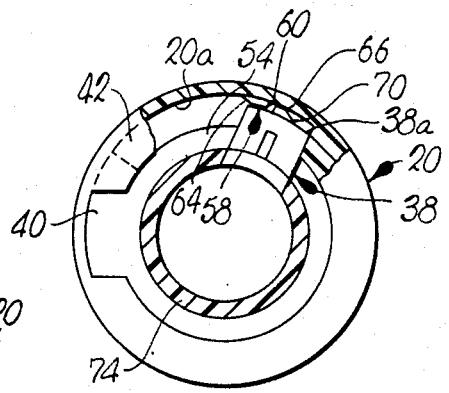
FIG. 20 is a horizontal cross-sectional view of the assembled collar and plunger component similar to FIG. 4 but showing the locking lug fully disposed in its locked position and a portion of the overhanging ledge of the collar broken away to reveal details of construction.

As illustrated, the nib 66 is generally centrally disposed on the lug 38 across the circumferential width thereof and is spaced down from the upper side 68 of lug 38 in such a manner as to be in rotative alignment with the shoulder 58 when the lug 38 is beneath the ledge 32 at the horizontal surface 50 thereof. As illustrated in FIG. 20, the lug 38 is of such radial length that its outermost radial tip 38*a* is spaced slightly radially inwardly from the interior wall 20*a* of collar 20 when lug 38 is beneath the ledge 42, thereby providing room for the nib 66 between the lug tip 38*a* and the wall 20*a*. As also illustrated in FIG. 20, the nib 66 has an inclined ramp surface 70 on the clockwise end thereof which matches the slope of the ramp surface 64 of shoulder 58, and further has an abrupt blocking surface 72 at the counterclockwise end thereof which matches in configuration the blocking surface 60 of shoulder 58.

Figure 15:
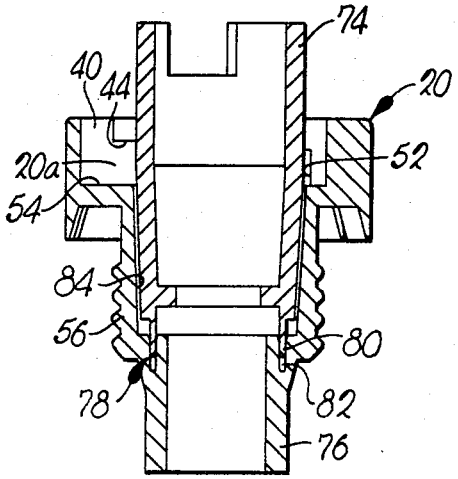
FIG. 15 is a vertical cross-sectional view through the assembled collar and plunger component corresponding to the position of the locking lug in FIG. 14.
Figure 17:
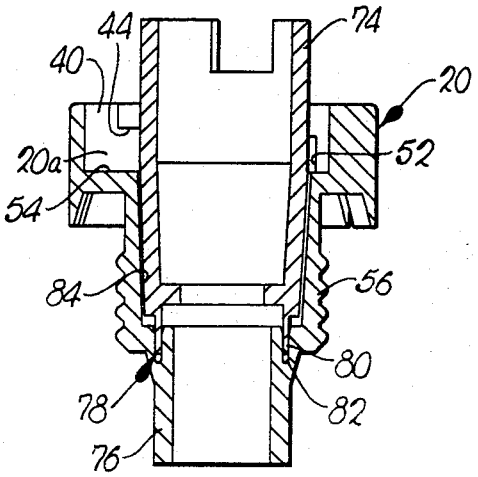
FIG. 17 is a vertical cross-sectional view of the collar and plunger component corresponding to the position of the lug in FIG. 16.
Figure 19:
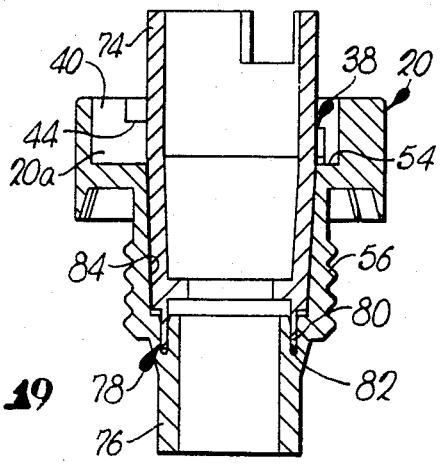
FIG. 19 is a vertical cross-sectional view of the collar and plunger component similar to FIGS. 15 and 17 but corresponding to the position of the locking lug in FIG. 18.

Illustrated in FIGS. 15, 17 and 19, are sealing structures between the locking ring component 74, which comprises a portion of the plunger 18, and the depending skirt portion 76 of the collar 20, such sealing structures being broadly denoted by the numeral 78. In the embodiment illustrated, the sealing structures 78 comprise a continuous annular tongue 80 about the lower end of the plunger ring portion 74 and a mating, continuous groove 82 in the proximal portion of the skirt 76. As the tongue 80 becomes wedged down into the groove 82 when the plunger 18 is fully depressed, the interface 84 between the ring portion 74 and collar 20 becomes sealed at its lower end against the admittance of liquid into the collar 20 from the interior of the plunger 18, thereby rendering the pump 10 leak-proof in this area.

Operation

The general principles of pumping operation of the pump 10 are believed readily understood by those skilled in the art and have been briefly set forth in the foregoing description. With respect to locking, when it is desired for the plunger 18 to be locked down, either for initial shipment and shelf storage or subsequent locking after customer use, the plunger 18 is first fully depressed with the lug 38 in axial alignment with the notch 40 in ledge 42. When the plunger 18 is depressed sufficiently to bring the lug 38 below the level of the bottom-most extremity of the abutment 44, the plunger 18 may then be rotated in a clockwise direction to slip the lug 38 under the ledge 42 and thereby retain the plunger 18 locked down against the action of the spring 30.

If the plunger 18 is then rotated in a clockwise direction for a sufficient distance after the lug 38 has been brought under the ledge 42, the upper side 68 of the lug 38 will come into force-transmitting engagement with the inclined cam surface 48 of the underside of the ledge 42. Thus, as the plunger 18 continues to be rotated clockwise after such interengagement, the cam surface 48 will progressively drive the plunger 18 axially downwardly as the sealing tongue 80 becomes progressively more tightly wedged within the sealing groove 82 therefor. This action "cinches up" the sealing structures 78 to assure a liquid-tight seal between the plunger 18 and the collar 20.

Figure 18:
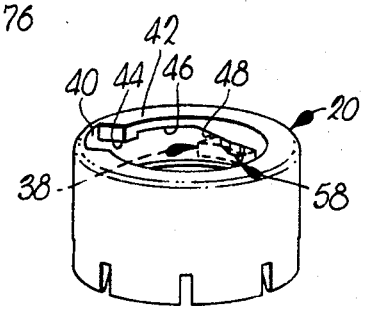
FIG. 18 is a perspective view of the collar and the locking lug similar to FIGS. 14 and 16 but with the lug disposed in its fully locked position.

These conditions are illustrated, for example, in FIGS. 14 through 17 in which it may be seen that the lug 38 is progressively moved axially downwardly within the collar 20 as the lug 38, and hence the plunger 18, is rotated in a clockwise direction. Finally, as illustrated in FIG. 18, when the topside 68 of the lug 38 moves under the horizontal surface 50 of the underside of ledge 42, the fully cinched up condition of FIG. 19 between the locking structures 78 is realized.

During the time that the lug 38 is moving beneath the cam surface 48, the nib 66 is coming into initial engagement with the shoulder 58. In this respect, as clockwise rotation continues, the ramp surface 70 of the nib 66 engages the corresponding ramp surface 64 of the shoulder 58 whereby to minimize the effect of the obstruction to continued clockwise rotation presented by the shoulder 58. Such moving interengagement between the ramp surfaces 64, 70 has the effect of slightly displacing the plunger 18 in a transverse direction whereby to enable the nib 66 to ride over and clear the shoulder 58.

Once the nib 66 has passed over the shoulder 58, it essentially "pops" into the space between the blocking surface 60 and the shoulder 52. Consequently, the lug 38 has its clockwisemost edge disposed for abutment against the shoulder 52, while the blocking surface 72 of its nib 66 is disposed for abuting engagement against the opposed blocking surface 60 of the shoulder 58. This trapping relationship, coupled with the abrupt blocking disposition of the two surfaces 60 and 72, has the effect of firmly securing the plunger 18 in this clockwisemost position in which it is fully locked down and the sealing structures 78 are fully engaged to prevent leakage. Thus, despite the influence of vibrations, shaking, jostling or other rough handling, the plunger 18 will normally remain fully locked down with the sealing structures 78 properly engaged. This is extremely significant and important considering that the container with which the pump 10 is associated can thereby be laid on its side, inverted or otherwise subjected to rough handling at the factory, during shipment, or during subsequent use, provided that other possible leakage points associated with the container and pump are properly accounted for.

Moreover, this type of locking action of the plunger 18 in its home position tends to discourage tampering since unlocking of the plunger 18 requires some degree of concerted effort on the part of the user. In this respect, in order to unlock the plunger 18, it must be rotated in a counterclockwise direction with sufficient force to cause the abrupt blocking surface 72 of nib 66 to ride up and over the opposed blocking surface 60 of projection 58 in spite of the fact that there is no camming action between such two surfaces tending to promote such overriding action. Once that restriction is overcome, however, the plunger 18 may be rotated counterclockwise significantly more freely as the spring 30 maintains the topside of the lug 68 up into sliding engagement with the underside of the ledge 42.

As the lug 38 then reaches the recessed stretch 46, the spring 30 maintains the lug 38 sufficiently upwardly pressed against ledge 42 that the counterclockwise leading edge of lug 38 comes into abutting engagement with the abutment 44, thereby inhibiting further counterclockwise rotation of the plunger 18. However, because the stretch 46 is relieved with respect to the most axially lower surface 50 of the ledge underside, which corresponds to the most axially depressed lower limit of the plunger 18, there is some room for the plunger 18 to be depressed slightly against the action of the spring 30 when the lug 38 is in the area of the relieved stretch 46. Thus, by applying such axial depressing force against the plunger 18 via the head 22 thereof, the lug 38 can be temporarily positioned below the abutment 44 so as to then permit the plunger 18 to be rotated further counterclockwise until the lug 38 is aligned vertically with the notch 40, whereupon the plunger 18 may then be extended.

It has been found in this regard that the normal tendency of the user when depressing the plunger 18 that short additional amount needed to pass the lug 38 beneath the abutment 44 is to use the palm of his hand to apply such depressing force against the head 22 and to thereafter leave the palm in engagement with the head 22 as the lug 38 is rotated into alignment with the notch 40. Consequently, in most cases the user's palm will remain on the head 22 at the instant the plunger 18 becomes unlocked from the collar 20, i.e., at that instant when the lug 38 becomes realigned with the notch 40 and the spring 30 is enabled to extend the plunger 18. Thus, the extension stroke of the plunger 18 tends to be a much more controlled, slow extension stroke than might otherwise be the case, thereby increasing the ability of the first extension stroke of the plunger 18 to function as an effective priming stroke of the pump.

We claim:

1. In a down-locking dispensing pump having a tubular body, an annular collar at one end of the body, a plunger reciprocable through the collar and within the body in pumping strokes between extended and depressed positions and retained against complete removal from the body, and means for releasably locking the plunger in said depressed position including a lug adjacent the outer end of said plunger which may be retained under a ledge of the collar after the plunger is first fully depressed to insert the lug into a notch in the ledge and then rotated an adequate amount in a certain direction to slip the lug under the ledge, said lug being disposed when out of axial alignment with said notch to overlie said ledge and abuttingly engage the latter during each full depression stroke of the plunger whereby to limit the extent of such depression stroke, the improvement comprising:

means defining a pair of circumferentially spaced shoulders on said collar below said ledge in position for trapping said lug therebetween when the plunger is rotated in said certain direction to one extreme of its travel as determined by the lug engaging the shoulder most circumferentially remote from said notch, the other of said shoulders and said lug having mutually interengageable means associated therewith which are configured and arranged to permit relatively unhindered movement of the lug in said certain direction past the other shoulder and into locking position against said remote shoulder while requiring substantially increased force to thereafter release the lug from the locking position by overriding the other shoulder during rotation of the plunger in the opposite direction.

2. In a down-locking dispensing pump as claimed in claim 1, wherein said lug has a radially outer end provided with a projection extending radially therefrom, said collar having an annular radially inwardly facing wall opposed to said outer end of the lug and having said other shoulder projecting radially inwardly therefrom into the path of travel of said projection, said projection and said other shoulder having ramp surfaces disposed for sliding interengagement when the plunger is rotated in said certain direction toward said locking position and opposed, blocking surfaces disposed for abutting interengagement when the plunger is rotated in the opposite direction out of said locking position.

3. In a down-locking dispensing pump having a tubular body, an annular collar at one end of the body, a plunger reciprocable through the collar and within the body in pumping strokes between extended and depressed positions, and means for releasably locking the plunger in said depressed position including a lug adjacent the outer end of said plunger which may be retained under a ledge of the collar after the plunger is first fully depressed to insert the lug into a notch in the ledge and then rotated an adequate amount in a certain direction to slip the lug under the ledge, the improvement comprising:

means defining a pair of circumferentially spaced shoulders on said collar below said ledge in position for trapping said lug therebetween when the plunger is rotated in said certain direction to one extreme of its travel as determined by the lug engaging the shoulder most circumferentially remote from said notch, the other of said shoulders and said lug having mutually interengageable means associated therewith which are configured and arranged to permit relatively unhindered movement of the lug in said certain direction past the other shoulder and into locking position against said remote shoulder while requiring substantially increased force to thereafter release the lug from the locking position by overriding the other shoulder during rotation of the plunger in the opposite direction, said lug having a radially outer end provided with a projection extending radially therefrom, said collar having an annular radially inwardly facing wall opposed to said outer end of the lug and having said other shoulder projecting radially inwardly therefrom into the path of travel of said projection, said projection and said other shoulder having ramp surfaces disposed for sliding interengagement when the plunger is rotated in said certain direction toward said locking position and opposed, blocking surfaces disposed for abutting interengagement when the plunger is rotated in the opposite direction out of said locking position, said plunger and said collar being provided with sealing structures which are axially mutually interengageable to seal the interface between the plunger and the collar when the plunger is fully depressed, said ledge having an underside which is at least in part inclined relative to an opposed topside of said lug for camming engagement therewith as the plunger is rotated toward said locking position whereby to effect final axial displacement of the plunger to squeeze said sealing structures together, the point of maximum displacement of said plunger by said underside of the ledge coinciding with the point at which the lug is trapped between said shoulders in said locking position.

4. In a down-locking dispensing pump as claimed in claim 3, wherein said underside includes an axially relieved stretch positioned between said inclined part and said notch, said relieved stretch being provided with a depending abutment at the end thereof proximal to said notch and disposed in the path of unlocking travel of said lug for blocking unlocking access of the lug to said notch unless the plunger is first depressed a sufficient additional amount as to permit passage of the lug under abutment.

5. A down-locking dispensing pump as claimed in claim 4, wherein said plunger is provided with spring means maintaining said lug thrusted yieldably up against said underside of the ledge when the lug is disposed under the same.

6. A down-locking dispensing pump as claimed in claim 1, wherein said ledge includes an underside engageable with the topside of said lug during locking rotation of the plunger and provided with an axially relieved stretch spaced circumferentially from said notch, said underside being further provided with a depending abutment between said relieved stretch and the notch and disposed in the path of unlocking travel of the lug for blocking unlocking access of the lug to said notch unless the plunger is first depressed a sufficient additional amount as to permit passage of the lug under said abutment.

7. A down-locking dispensing pump as claimed in claim 6, wherein said plunger is provided with spring means maintaining said lug thrusted yieldably up against said underside of the ledge when the lug is disposed under the same.

* * * * *